US010588370B2

(12) United States Patent
Paleno

(10) Patent No.: US 10,588,370 B2
(45) Date of Patent: Mar. 17, 2020

(54) REVERSIBLE HAT

(71) Applicant: Michael Paleno, Los Angeles, CA (US)

(72) Inventor: Michael Paleno, Los Angeles, CA (US)

( * ) Notice: Subject to any disclaimer, the term of this patent is extended or adjusted under 35 U.S.C. 154(b) by 108 days.

(21) Appl. No.: 15/744,605

(22) PCT Filed: Jul. 15, 2016

(86) PCT No.: PCT/US2016/042650
§ 371 (c)(1),
(2) Date: Jan. 12, 2018

(87) PCT Pub. No.: WO2017/011805
PCT Pub. Date: Jan. 19, 2017

(65) Prior Publication Data

US 2018/0206574 A1 Jul. 26, 2018

Related U.S. Application Data

(60) Provisional application No. 62/193,262, filed on Jul. 16, 2015.

(51) Int. Cl.
*A42B 1/20* (2006.01)
*A42B 1/00* (2006.01)

(52) U.S. Cl.
CPC ..... *A42B 1/206* (2013.01); *A42B 1/004* (2013.01); *A42B 1/006* (2013.01)

(58) Field of Classification Search
CPC ..... A42B 1/206; A42B 1/004; A42B 1/006; A45F 4/12; A45F 4/02; A41D 15/04
USPC ..... 2/171, 301
See application file for complete search history.

(56) References Cited

U.S. PATENT DOCUMENTS 1,816,346 A * 7/1931 Silverstein ..... A42B 1/066 2/172
3,187,345 A 6/1965 Holford
4,175,411 A * 11/1979 Allen ..... A41G 7/00 2/173
5,085,320 A * 2/1992 Scott ..... A63B 47/007 150/107

(Continued)

FOREIGN PATENT DOCUMENTS

FR 3063653 A1 * 9/2018 ..... A63B 41/00

OTHER PUBLICATIONS

Sefelt. "Synthetic Felts and Fibers." Southeastern Felt | Synthetics, May 25, 2011, www.sefelt.com/synthet.html. (Year: 2011).*

(Continued)

*Primary Examiner* — Khoa D Huynh
*Assistant Examiner* — Grace Huang

(57) ABSTRACT

A reversible cover apparatus comprises a cover portion having an opening configured for receiving an object to cover the object and a pouch portion coupled to the cover portion, the pouch portion having an opening for receiving the cover portion. The reversible cover apparatus is reversible between: a first position as a covering for an object wherein the pouch portion is disposed in the cover portion and the cover portion opening can receive an object to cover the object; and a reversed, second position, wherein the cover portion is disposed within the pouch portion through the pouch portion opening and an outer surface of the pouch portion provides an external appearance of a desired item.

12 Claims, 18 Drawing Sheets

(56) References Cited

U.S. PATENT DOCUMENTS

| | | | | | |
|---|---|---|---|---|---|
| 5,343,567 | A * | 9/1994 | Zumbiel | A42B 1/004 | 2/195.1 |
| 5,551,087 | A * | 9/1996 | Blutstein | A42B 1/046 | 2/173 |
| 5,839,577 | A * | 11/1998 | Friedler | A45C 3/00 | 206/315.1 |
| D472,048 | S * | 3/2003 | Rugg | D3/257 | |
| 6,892,916 | B1 * | 5/2005 | Rugg | A45C 13/103 | 224/645 |
| 7,257,845 | B1 * | 8/2007 | Conner, IV | A42B 1/006 | 2/209.12 |
| 8,079,451 | B2 * | 12/2011 | Rothschild | A45F 4/06 | 190/100 |
| 2004/0002284 | A1 * | 1/2004 | Leal | A63B 43/06 | 446/484 |
| 2006/0143776 | A1 * | 7/2006 | Hosogai | A42B 1/062 | 2/110 |
| 2006/0237106 | A1 * | 10/2006 | Pearson | A45C 3/00 | 150/128 |
| 2012/0094787 | A1 * | 4/2012 | Weiss | A63B 43/00 | 473/438 |
| 2015/0296901 | A1 * | 10/2015 | Robertson | A42B 1/006 | 2/209.11 |
| 2018/0153229 | A1 * | 6/2018 | Virgilio | A41D 1/02 | |

OTHER PUBLICATIONS

Inside Out Ball—4 inch. YouTube [online]. Office Playground, 2010 [retrieved on Sep. 23, 2016]. Retrieved from the Internet: <URL: https://www.youtube.com/watch?v=4CrEwo8Nc3E>.

International Search Report and Written Opinion for PCT Serial No. PCT/US16/42650 dated Dec. 15, 2016.

* cited by examiner

REVERSIBLE HAT

CROSS-REFERENCE TO RELATED APPLICATION

This application is a U.S. National Phase Patent Application under 35 U.S.C. § 371 of International Application Number PCT/US2016/042650, filed Jul. 15, 2016, which claims the priority benefit of U.S. Provisional Patent Application Ser. No. 62/193,262, filed Jul. 16, 2015, both of which are incorporated herein by reference in their entirety for all purposes.

TECHNICAL FIELD

The present disclosure relates to apparel, and more particularly to hats.

BACKGROUND

A hat is a head covering which may be worn for protection against the elements and/or as a fashion accessory.

SUMMARY

One exemplary embodiment may include a reversible cover apparatus, comprising: a cover portion having an opening configured for receiving an object to cover the object; and a pouch portion coupled to the cover portion, the pouch portion having an opening for receiving the cover portion; where the reversible cover apparatus is reversible between: a first position as a covering for an object where the pouch portion is disposed in the cover portion and the cover portion opening can receive an object to cover the object; and a reversed, second position, where the cover portion is disposed within the pouch portion through the pouch portion opening, and an outer surface of the pouch portion provides an external appearance of a desired item. In additional exemplary reversible cover apparatus embodiments, in the first position an outer surface of the cover portion is visible; and in the second position the outer surface of the pouch portion is visible and provides an external appearance of said item.

Another exemplary embodiment may include a reversible hat, comprising: a hat portion; and a pouch portion; where the hat portion is coupled to the pouch portion, the pouch portion having an opening for receiving the hat portion; where the reversible hat is reversible between a first position as a head covering and a second position as a ball, where in the second position the hat portion is disposed within the pouch portion; where in the first position an outer surface of the hat portion is visible; and where in the second position an outer surface of the pouch portion is visible, the peripheries of the pouch portion opening are attached to close the opening, such that the hat portion is disposed within the outer surface of the pouch portion.

In additional exemplary reversible hat embodiments, the hat portion further comprises an inner surface, the hat portion tapering from a lower portion proximate an edge to an upper portion proximate a crown; and where the pouch portion comprises a four-pointed flower shaped pattern comprising an outer surface and an inner surface, the four-pointed flow shaped pattern comprising: a first petal, a second petal, a third petal, and a fourth petal, where adjacent sides of the first petal and the second petal are fixedly attached, where adjacent sides of the third petal and the fourth petal are fixedly attached, where a first fastener detachably attaches adjacent sides of the first petal and the third petal, where a second fastener detachably attaches adjacent sides of the second petal and the fourth petal, and where the inner surface of the pouch portion is fixedly attached to the inner surface of the hat portion proximate the crown; where in the first position the outer surface of the hat portion is visible, the adjacent sides of the first petal and the third petal are not attached, and the adjacent sides of the second petal and the fourth petal are not attached; and where in the second position the outer surface of the pouch portion is visible, the adjacent sides of the first petal and the third petal are detachably attached, the adjacent sides of the second petal and the fourth petal are detachably attached, and the hat portion is disposed within the outer surface of the four-pointed flower shaped pattern as a bladder of the prolate spheroid.

In additional exemplary reversible hat embodiments, the hat portion is a knit cap. In additional exemplary reversible hat embodiments, the hat portion is made of one or more of: wool, cotton, and synthetic fibers. In additional exemplary reversible hat embodiments, the outer surface of the pouch portion comprises a printed pattern. In additional exemplary reversible hat embodiments, the outer surface of the pouch portion comprises one or more laces. In additional exemplary reversible hat embodiments, the outer surface of the pouch portion comprises one or more grommets. In additional exemplary reversible hat embodiments, the inner surface of the pouch portion is fixedly attached to the inner surface of the hat portion via stitching. In additional exemplary reversible hat embodiments, the first fastener and the second fastener are zippers. In additional exemplary reversible hat embodiments, the first fastener and the second fasteners are at least one of: a zipper, a snap, a button, a magnet, a hook and loop fastener, and an adhesive. In additional exemplary reversible hat embodiments, the reversible hat is converted from the first position to the second position by a user. In additional exemplary reversible hat embodiments, the reversible hat is converted from the second position to the first position by the user. In additional exemplary reversible hat embodiments, the pouch portion is made of one or more of: leather, rubber, and plastic.

In additional exemplary reversible hat embodiments, adjacent sides of the first petal and the second petal are fixedly attached via stitching, and wherein adjacent sides of the third petal and the fourth petal are fixedly attached via stitching. In additional exemplary reversible hat embodiments, the curvature of the pouch portion aligns with the curvature of the hat portion proximate the crown such that the hat portion has a standard appearance in the first position. Additional exemplary reversible hat embodiments include one or more lights. In additional exemplary reversible hat embodiments, the one or more lights are light emitting diodes (LEDs). In additional exemplary reversible hat embodiments, the one or more lights are disposed on the outer surface of the pouch portion. In additional exemplary reversible hat embodiments, the one or more lights are disposed beneath the outer surface of the pouch portion.

In additional exemplary reversible hat embodiments, the pouch portion comprises one or more partially transparent panels. In additional exemplary reversible hat embodiments, the pouch portion comprises one or more opaque panels. In additional exemplary reversible hat embodiments, the pouch portion is partially transparent. Additional exemplary reversible hat embodiments include a battery for providing power to the one or more lights. Additional exemplary reversible hat embodiments include a processor and an accelerometer in communication with the one or more lights. In additional exemplary reversible hat embodiments, the one or more lights are illuminated when motion is detected by the accelerometer. Additional exemplary reversible hat embodiments include a switch, wherein the one or more lights are illuminated when motion is detected by the accelerometer. In additional exemplary reversible hat embodiments, the reversible hat has the outer appearance of a football in the second position and a standard hat in the first position. In additional exemplary reversible hat embodiments, the reversible hat has the outer appearance of a rugby ball in the second position and a standard hat in the first position.

An exemplary apparatus embodiment may include: a hat comprising an outer surface and an inner surface, the hat tapering from a lower portion proximate an edge to an upper portion proximate a crown; and a plurality of panels comprising an outer surface and an inner surface, the plurality of panels comprising: a first sphere half and a second sphere half, where a portion of an edge of the first sphere half is fixedly attached to a portion of an edge of the second sphere half, where a remaining edge of the first sphere half not fixedly attached to the second sphere half is detachably attached to a remaining edge of the second sphere half via a fastener, and where the inner surface of the plurality of panels is fixedly attached to the inner surface of the hat proximate the crown; where the apparatus is reversible between a first position as a head covering and a second position as a sphere; where in the first position the outer surface of the hat is visible, and the detachably attached portion of the first sphere and the second sphere is not attached; and where in the second position the outer surface of the plurality of panels is visible, the detachably attached portion of the first sphere and the second sphere is detachably attached, and the hat is disposed within the outer surface of the plurality of panels as a bladder of the sphere.

In additional exemplary apparatus embodiments, the outer surface of the plurality of panels comprises a printed pattern. In additional exemplary apparatus embodiments, the apparatus has the outer appearance of a baseball in the second position and a standard hat in the first position. In additional exemplary apparatus embodiments, the apparatus has the outer appearance of a soccer ball in the second position and a standard hat in the first position. In additional exemplary apparatus embodiments, the apparatus has the outer appearance of a basketball in the second position and a standard hat in the first position. In additional exemplary apparatus embodiments, the inner surface of the plurality of panels is fixedly attached to the inner surface of the hat via stitching. In additional exemplary apparatus embodiments, the fastener is at least one of: a zipper, a snap, a button, a magnet, a hook and loop fastener, and an adhesive. Additional exemplary apparatus embodiments include one or more lights. In additional exemplary apparatus embodiments, the one or more lights are light emitting diodes (LEDs). In additional exemplary apparatus embodiments, the one or more lights are disposed on the outer surface of the plurality of panels. In additional exemplary apparatus embodiments, the one or more lights are disposed beneath the outer surface of the plurality of panels.

In additional exemplary apparatus embodiments, the plurality of panels comprises one or more partially transparent panels. In additional exemplary apparatus embodiments, the plurality of panels comprises one or more opaque panels. In additional exemplary apparatus embodiments, the plurality of panels is partially transparent. Additional exemplary apparatus embodiments include a battery for providing power to the one or more lights. Additional exemplary apparatus embodiments include a processor and an accelerometer in communication with the one or more lights. In additional exemplary apparatus embodiments, the one or more lights are illuminated when motion is detected by the accelerometer. Additional exemplary apparatus embodiments include a switch, where the one or more lights are illuminated when motion is detected by the accelerometer.

An exemplary method embodiment may include: attaching adjacent sides of a first petal and a second petal of a four-pointed flower shaped pattern fixedly; attaching adjacent sides of a third petal and a fourth petal of the four-pointed flower shaped pattern fixedly; attaching a first fastener between adjacent sides of the first petal and the third petal, where the first fastener is a detachably attachable fastener; attaching a second fastener between adjacent sides of the second petal and the fourth petal, where the second fastener is a detachably attachable fastener; attaching an inner surface of the four-pointed flower shaped pattern to an inner surface of a hat proximate a crown of the hat; where the hat is reversible between a first position as a head covering and a second position as a prolate spheroid.

In additional exemplary method embodiments, the adjacent sides of the first petal and the second petal are fixedly attached via stitching, and where the adjacent sides of the third petal and the fourth petal are fixedly attached via stitching. In additional exemplary method embodiments, the first fastener and the second fastener are at least one of: a zipper, a snap, a button, a magnet, a hook and loop fastener, and an adhesive.

This brief summary has been provided so that the nature of this disclosure may be understood quickly. A more complete understanding of the disclosure can be obtained by reference to the following detailed description of the various aspects thereof in connection with the attached drawings.

BRIEF DESCRIPTION OF THE DRAWINGS

The foregoing features and other features will now be described with reference to the drawings of various aspects. In the drawings, the same components have the same reference numerals. The illustrated aspects are intended to illustrate, but not to limit the present disclosure. The drawings include the following Figures.

DETAILED DESCRIPTION

Figure 1A:
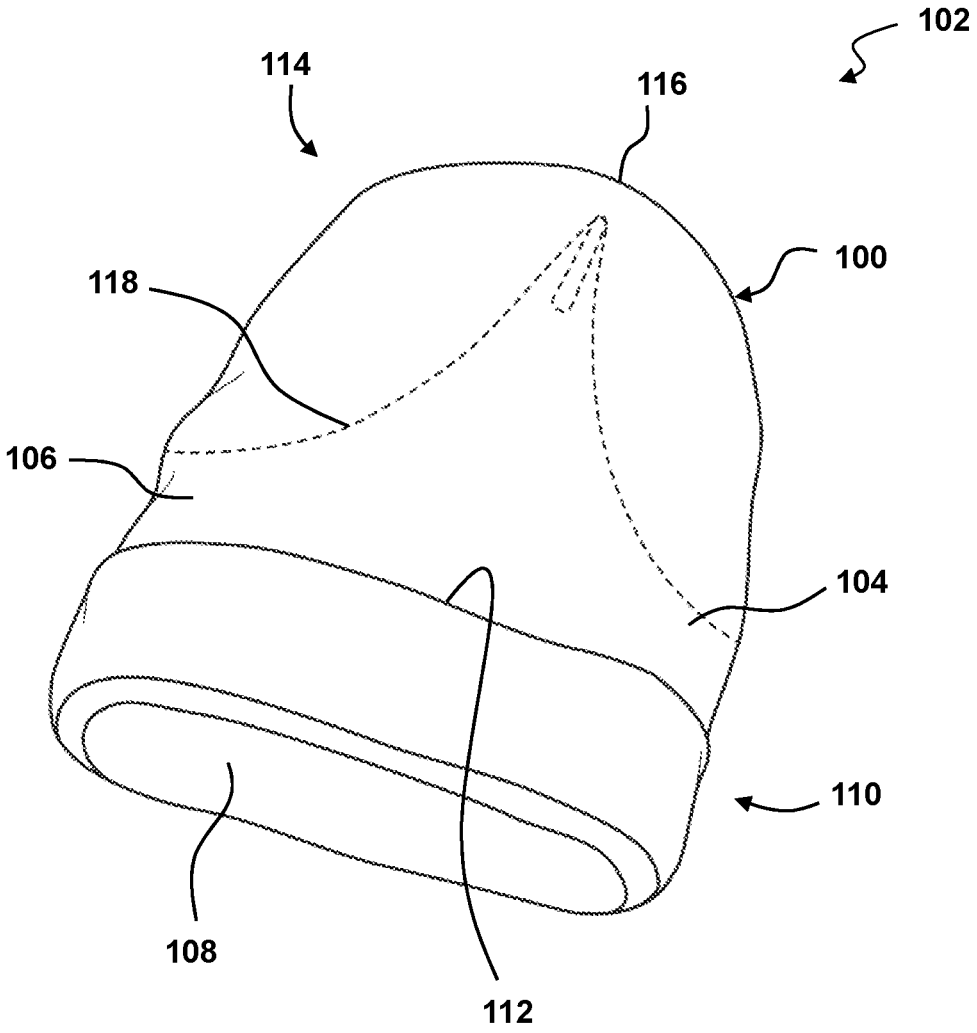
FIG. 1A depicts a perspective view of an exemplary reversible cover apparatus comprising a reversible hat in a first position as a head covering, showing a first side of the hat, according to one embodiment.

The following description is made for the purpose of illustrating the general principles of the embodiments disclosed herein and is not meant to limit the concepts disclosed herein. Further, particular features described herein can be used in combination with other described features in each of the various possible combinations and permutations. Unless otherwise specifically defined herein, all terms are to be given their broadest possible interpretation including meanings implied from the description as well as meanings understood by those skilled in the art and/or as defined in dictionaries, treatises, etc.

In an embodiment of an apparatus disclosed herein comprises a reversible cover apparatus, including a cover portion, and a pouch portion. Wherein the cover portion is coupled to the pouch portion, and the pouch portion has an opening for receiving the cover portion. The cover portion is configured for placing over an object to cover the object. The reversible cover apparatus is reversible between a first position as a covering for an object and a second position providing exterior appearance (and functionality) of a desired item such as a ball, stuffed object, stuffed animal, etc. In the second position, the cover portion is disposed within the pouch portion. The pouch portion is configured (e.g., constructed from panels of particular shape and size) to have exterior surfaces such that when the reversible cover is in the second position the exterior of pouch portion resembles a desired item such as stuffed ball, stuffed animal, etc. Though some of the embodiments disclosed herein are in the form of a reversible head covering such as a reversible hat that has the shape of a ball when reversed, another embodiment may comprise a reversible golf club covering that have the shape of a stuffed animal when reversed. As used herein, the term reversible includes common definitions such as capable of being turned inside-out, the inner surface turned outward, the outer/exterior surface turned inwards, etc.

One embodiment disclosed herein comprises a reversible cover including a cover portion (e.g., hat portion) and a pouch portion, where the cover portion is coupled to the pouch portion. The cover portion may be disposed within the pouch portion, such that the pouch portion provides the exterior appearance of a desired item (such a ball), when the hat portion is disposed therein. One example embodiment disclosed herein comprises a reversible hat including a hat portion and a pouch portion, where the hat portion is coupled to the pouch portion. The hat portion may be disposed within the pouch portion, such that the pouch portion provides the exterior appearance of a ball, with the hat portion is disposed therein. One example embodiment disclosed herein comprises a reversible golf club cover including a golf club cover portion and a pouch portion, where the golf club cover portion is coupled to the pouch portion. The golf club cover portion may be disposed within the pouch portion, such that the pouch portion provides the exterior appearance of a ball, with the golf club cover portion is disposed therein. Embodiments may be implemented for other reversible cover applications.

The disclosed reversible hat may transition between a first position and a second position. In the first position, the outer surface of the hat is visible and the hat may be worn so as to cover the crown of a user's head. In the second position, the hat is reversed and the hat material is enclosed within an outer surface of a ball (e.g., a football, baseball, basketball, soccer ball, rugby ball, or golf club head cover) in place of a bladder of a typical air-filled ball. The ball may be constructed from a plurality of panels that are not attached in the first position and detachably attached via one or more fasteners in the second position. The reversible hat may be transitioned from the first position, to the second position, and then back to the first position.

One exemplary embodiment may include a reversible cover apparatus 100, comprising: a cover portion 104 having an opening 210 configured for receiving an object to cover the object; and a pouch portion 200 coupled to the cover portion, the pouch portion having an opening 212 for receiving the cover portion; where the reversible cover apparatus is reversible between: a first position as a covering for an object where the pouch portion is disposed in the cover portion and the cover portion opening can receive an object to cover the object; and a reversed, second position, where the cover portion is disposed within the pouch portion through the pouch portion opening, and an outer surface 202 of the pouch portion provides an external appearance of a desired item. In additional exemplary reversible cover apparatus embodiments, in the first position an outer surface 106 of the cover portion is visible; and in the second position the outer surface 202 of the pouch portion is visible and provides an external appearance of said item.

Another exemplary embodiment may include a reversible hat 100, comprising: a hat portion 104; and a pouch portion 200; where the hat portion is coupled to the pouch portion, the pouch portion having an opening 212 for receiving the hat portion; where the reversible hat is reversible between a first position as a head covering and a second position as a ball, where in the second position the hat portion is disposed within the pouch portion; where in the first position an outer surface 106 of the hat portion is visible; and where in the second position an outer surface 202 of the pouch portion is visible, the peripheries 214 of the pouch portion opening are attached to close the opening, such that the hat portion is disposed within the outer surface of the pouch portion.

In additional exemplary reversible hat embodiments, the hat portion further comprises an inner surface 108, the hat portion tapering from a lower portion 110 proximate an edge 112 to an upper portion 114 proximate a crown 116; and where the pouch portion comprises a four-pointed flower shaped pattern 200 comprising an outer surface 202 and an inner surface 204, the four-pointed flow shaped pattern comprising: a first petal 502, a second petal 504, a third petal 506, and a fourth petal 508, where adjacent sides 510, 512 of the first petal and the second petal are fixedly attached, where adjacent sides 514, 516 of the third petal and the fourth petal are fixedly attached, where a first fastener 300 detachably attaches adjacent sides 518, 520 of the first petal and the third petal, where a second fastener 302 detachably attaches adjacent sides 522, 524 of the second petal and the fourth petal, and where the inner surface of the pouch portion is fixedly attached to the inner surface of the hat portion proximate the crown; where in the first position the outer surface of the hat portion is visible, the adjacent sides of the first petal and the third petal are not attached, and the adjacent sides of the second petal and the fourth petal are not attached; and where in the second position the outer surface of the pouch portion is visible, the adjacent sides of the first petal and the third petal are detachably attached, the adjacent sides of the second petal and the fourth petal are detachably attached, and the hat portion is disposed within the outer surface of the four-pointed flower shaped pattern as a bladder of the prolate spheroid.

In additional exemplary reversible hat embodiments, the hat portion is a knit cap. In additional exemplary reversible hat embodiments, the hat portion is made of one or more of: wool, cotton, and synthetic fibers. In additional exemplary reversible hat embodiments, the outer surface of the pouch portion comprises a printed pattern. In additional exemplary reversible hat embodiments, the outer surface of the pouch portion comprises one or more laces 206. In additional exemplary reversible hat embodiments, the outer surface of the pouch portion comprises one or more grommets 208. In additional exemplary reversible hat embodiments, the inner surface of the pouch portion is fixedly attached to the inner surface of the hat portion via stitching. In additional exemplary reversible hat embodiments, the first fastener and the second fastener are zippers. In additional exemplary reversible hat embodiments, the first fastener and the second fasteners are at least one of: a zipper, a snap, a button, a magnet, a hook and loop fastener, and an adhesive. In additional exemplary reversible hat embodiments, the reversible hat is converted from the first position to the second position by a user. In additional exemplary reversible hat embodiments, the reversible hat is converted from the second position to the first position by the user. In additional exemplary reversible hat embodiments, the pouch portion is made of one or more of: leather, rubber, and plastic.

In additional exemplary reversible hat embodiments, adjacent sides of the first petal and the second petal are fixedly attached via stitching, and wherein adjacent sides of the third petal and the fourth petal are fixedly attached via stitching. In additional exemplary reversible hat embodiments, the curvature of the pouch portion aligns with the curvature of the hat portion proximate the crown such that the hat portion has a standard appearance in the first position. Additional exemplary reversible hat embodiments include one or more lights 1002, 1004, 1006, 1010. In additional exemplary reversible hat embodiments, the one or more lights are light emitting diodes (LEDs). In additional exemplary reversible hat embodiments, the one or more lights are disposed on the outer surface of the pouch portion. In additional exemplary reversible hat embodiments, the one or more lights are disposed beneath the outer surface of the pouch portion.

In additional exemplary reversible hat embodiments, the pouch portion comprises one or more partially transparent panels 1012. In additional exemplary reversible hat embodiments, the pouch portion comprises one or more opaque panels 1022. In additional exemplary reversible hat embodiments, the pouch portion is partially transparent. Additional exemplary reversible hat embodiments include a battery 1014 for providing power to the one or more lights. Additional exemplary reversible hat embodiments include a processor 1016 and an accelerometer 1018 in communication with the one or more lights. In additional exemplary reversible hat embodiments, the one or more lights are illuminated when motion is detected by the accelerometer. Additional exemplary reversible hat embodiments include a switch, wherein the one or more lights are illuminated when motion is detected by the accelerometer. In additional exemplary reversible hat embodiments, the reversible hat has the outer appearance of a football in the second position and a standard hat in the first position. In additional exemplary reversible hat embodiments, the reversible hat has the outer appearance of a rugby ball in the second position and a standard hat in the first position.

An exemplary apparatus embodiment may include: a hat portion 104 comprising an outer surface 106 and an inner surface 108, the hat tapering from a lower portion 110 proximate an edge 112 to an upper portion 114 proximate a crown 116; and a plurality of panels 600 comprising an outer surface and an inner surface, the plurality of panels comprising: a first sphere half 602 and a second sphere half 604, where a portion of an edge of the first sphere half is fixedly attached 606 to a portion of an edge of the second sphere half, where a remaining edge 608 of the first sphere half not fixedly attached to the second sphere half is detachably attached to a remaining edge 610 of the second sphere half via a fastener 612, and where the inner surface of the plurality of panels is fixedly attached to the inner surface of the hat proximate the crown; where the apparatus is reversible between a first position as a head covering and a second position as a sphere; where in the first position the outer surface of the hat is visible, and the detachably attached portion of the first sphere and the second sphere is not attached; and where in the second position the outer surface of the plurality of panels is visible, the detachably attached portion of the first sphere and the second sphere is detachably attached, and the hat is disposed within the outer surface of the plurality of panels as a bladder of the sphere.

In additional exemplary apparatus embodiments, the outer surface of the plurality of panels comprises a printed pattern. In additional exemplary apparatus embodiments, the apparatus has the outer appearance of a baseball in the second position and a standard hat in the first position. In additional exemplary apparatus embodiments, the apparatus has the outer appearance of a soccer ball in the second position and a standard hat in the first position. In additional exemplary apparatus embodiments, the apparatus has the outer appearance of a basketball in the second position and a standard hat in the first position. In additional exemplary apparatus embodiments, the inner surface of the plurality of panels is fixedly attached to the inner surface of the hat via stitching. In additional exemplary apparatus embodiments, the fastener is at least one of: a zipper, a snap, a button, a magnet, a hook and loop fastener, and an adhesive. Additional exemplary apparatus embodiments include one or more lights 1002, 1004, 1006, 1010. In additional exemplary apparatus embodiments, the one or more lights are light emitting diodes (LEDs). In additional exemplary apparatus embodiments, the one or more lights are disposed on the outer surface of the plurality of panels. In additional exemplary apparatus embodiments, the one or more lights are disposed beneath the outer surface of the plurality of panels.

In additional exemplary apparatus embodiments, the plurality of panels comprises one or more partially transparent panels 1012. In additional exemplary apparatus embodiments, the plurality of panels comprises one or more opaque panels 1022. In additional exemplary apparatus embodiments, the plurality of panels is partially transparent. Additional exemplary apparatus embodiments include a battery 1014 for providing power to the one or more lights. Additional exemplary apparatus embodiments include a processor 1016 and an accelerometer 1018 in communication with the one or more lights. In additional exemplary apparatus embodiments, the one or more lights are illuminated when motion is detected by the accelerometer. Additional exemplary apparatus embodiments include a switch, where the one or more lights are illuminated when motion is detected by the accelerometer.

An exemplary method embodiment may include: attaching adjacent sides 510, 512 of a first petal 502 and a second petal 504 of a four-pointed flower shaped pattern 200 fixedly; attaching adjacent sides 514, 516 of a third petal 506 and a fourth petal 508 of the four-pointed flower shaped pattern fixedly; attaching a first fastener 300 between adjacent sides 518, 520 of the first petal and the third petal, where the first fastener is a detachably attachable fastener; attaching a second fastener 302 between adjacent sides 522, 524 of the second petal and the fourth petal, where the second fastener is a detachably attachable fastener; attaching an inner surface 204 of the four-pointed flower shaped pattern to an inner surface 108 of a hat portion 104 proximate a crown 116 of the hat; where the hat is reversible between a first position 102 as a head covering and a second position 400 as a prolate spheroid.

In additional exemplary method embodiments, the adjacent sides of the first petal and the second petal are fixedly attached via stitching, and where the adjacent sides of the third petal and the fourth petal are fixedly attached via stitching. In additional exemplary method embodiments, the first fastener and the second fastener are at least one of: a zipper, a snap, a button, a magnet, a hook and loop fastener, and an adhesive.

FIGS. 1-4 depict perspective views of the reversible hat transitioning from a first position as a head covering to a second position as a prolate spheroid. In other embodiments, the reversible hat may be a sphere in a second position.

Referring to FIGS. 1A-1B, 2A-2C, in one embodiment, a reversible cover apparatus 100 comprises a cover portion 104 having an opening 210 configured for receiving an object to cover the object; and a pouch portion 200 coupled to the cover portion, the pouch portion having an opening 212 for receiving the cover portion. Wherein the reversible cover apparatus is reversible between: (a) a first position as a covering for an object wherein the pouch portion is disposed in the cover portion and the cover portion opening 210 can receive an object to cover the object; and (b) a reversed, second position, wherein the cover portion is disposed within the pouch portion through the pouch portion opening 212, and an outer surface 202 of the pouch portion provides an external appearance of an item.

Figure 1B:
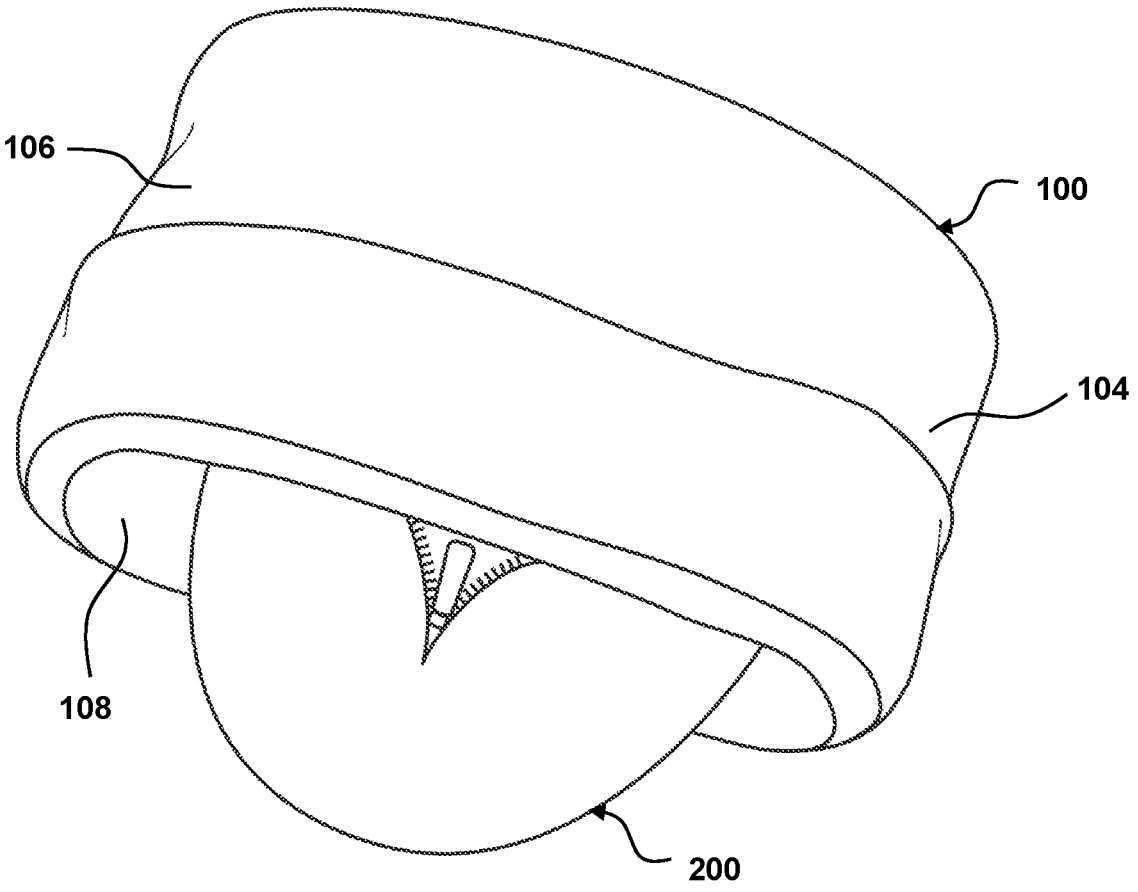
FIG. 1B depicts a perspective view of the exemplary reversible hat being inverted (reversed) from the first position of FIG. 1A to the second position of FIG. 4, according to one embodiment.
Figure 2A:
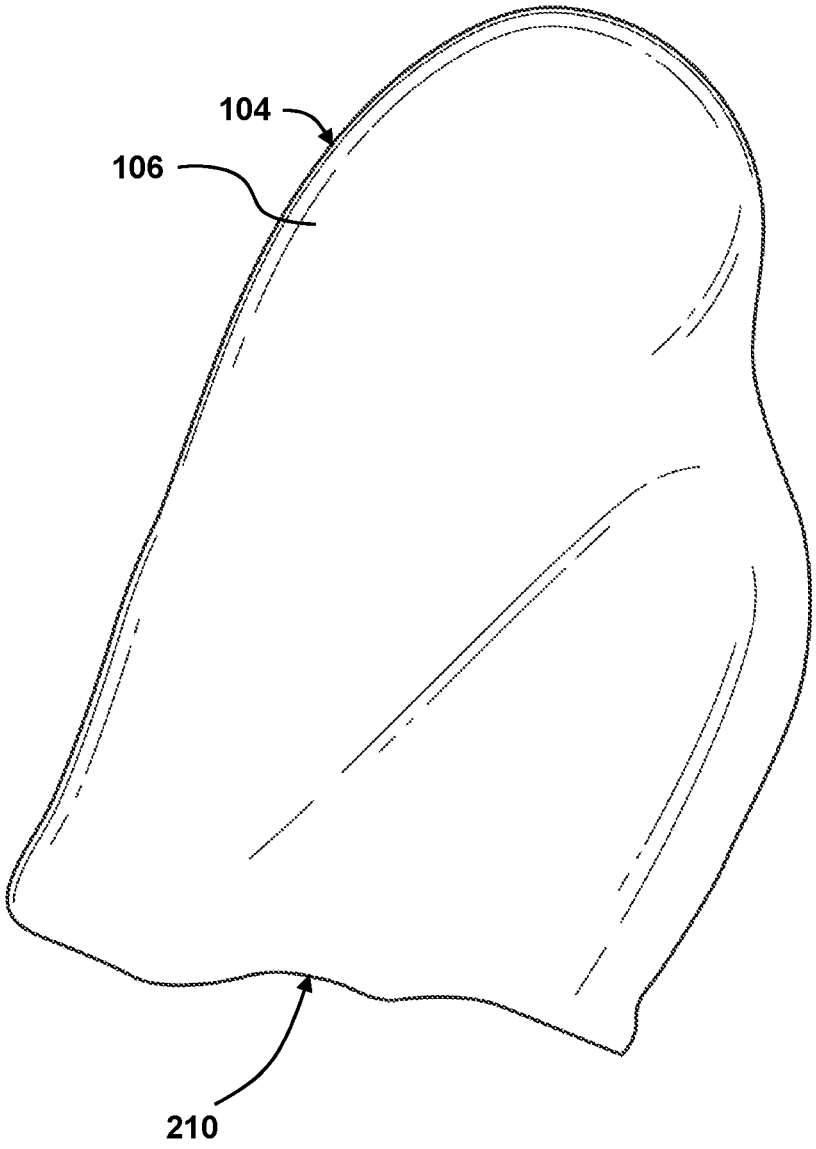
FIG. 2A depicts a cover portion of the exemplary reversible hat of FIG. 1A, according to one embodiment.

Referring to FIGS. 1A-1B, 2A-2C, an example reversible apparatus disclosed herein comprises a reversible hat 100 including a hat portion 104 and a pouch portion 200, wherein the hat portion 104 is coupled to the pouch portion 200. The hat portion 104 may be disposed within the pouch portion, such that the pouch portion 200 provides the exterior appearance of a ball, when the hat portion 104 is disposed therein, as shown in FIGS. 2A and 3A-3B.

Specifically, FIG. 1A shows the reversible hat 100 in a first position 102 as a head covering. The reversible hat 100 includes a hat portion 104 having an outer surface 106 and an inner surface 108. The hat portion 104 may be made of cloth, wool, cotton, synthetic fibers, or a blend of materials. The outer surface 106 and the inner surface 108 are relative to the first position 102 and do not act to limit which side of the hat may be visible to an external observer. The hat portion 104 may taper from a lower portion 110 proximate an edge 112 of the hat portion 104 to an upper portion 114 proximate a crown 116 of the hat portion 104. The hat portion 104 may be a knit cap, or beanie. In some embodiments, the hat portion 104 may be other hat styles and has additional features, such as a pom-pom, tassel, collapsible brim, and/or ear covers. Dashed lines 118 show the location of a four-pointed flower shaped pattern attached to the inner surface 108 of the hat portion 104. In the first position 102, the reversible hat 100 acts as a head covering and looks like an ordinary hat to an external observer.

FIG. 1B depicts a perspective view of the exemplary reversible hat 100 being inverted from the first position of FIG. 1A to the second position of FIG. 4A.

FIG. 2A depicts a cover portion 104 of the exemplary reversible hat of FIG. 1A. The cover portion 104 has an outer surface 106 and an opening 210.

Figure 2B:
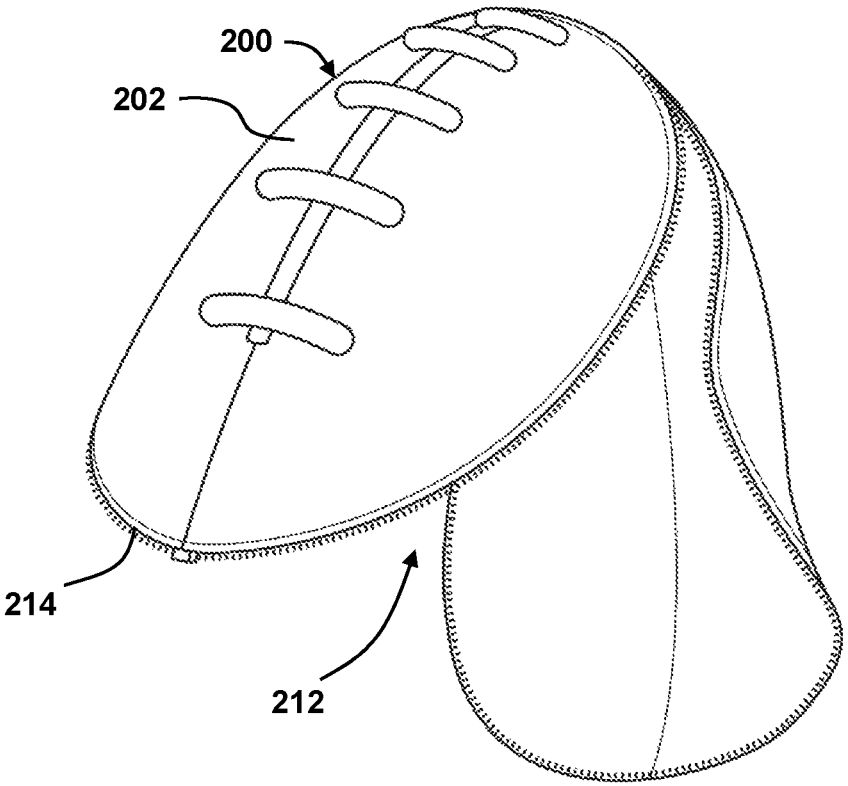
FIG. 2B depicts a pouch portion of the exemplary reversible hat of FIG. 1A, according to one embodiment.
Figure 3A:
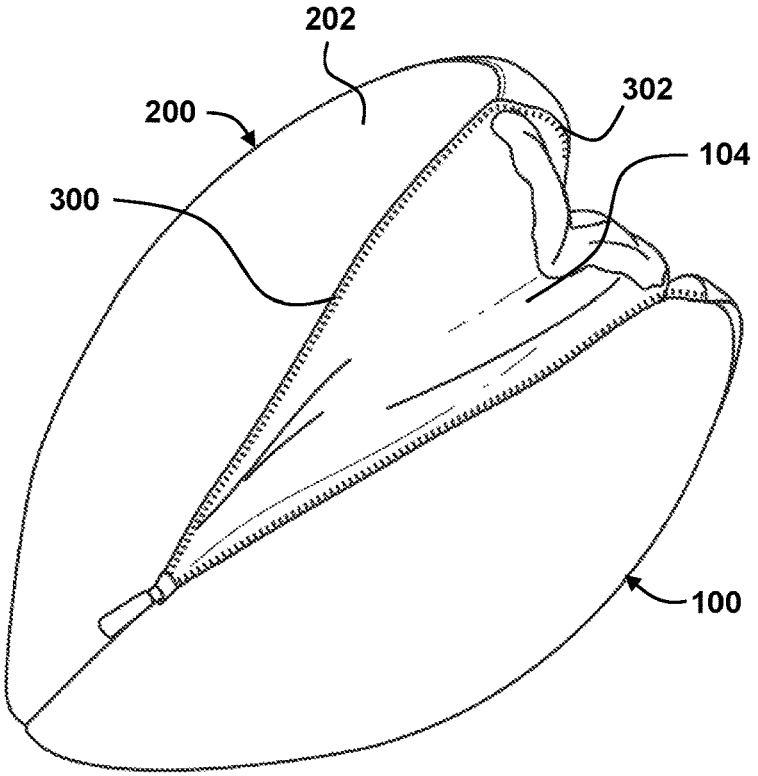
FIG. 3A depicts a perspective view of the reversible hat of FIG. 1A with a hat portion functioning as a bladder for a pouch portion comprising four-pointed flower shaped pattern, according to one embodiment.
Figure 3B:
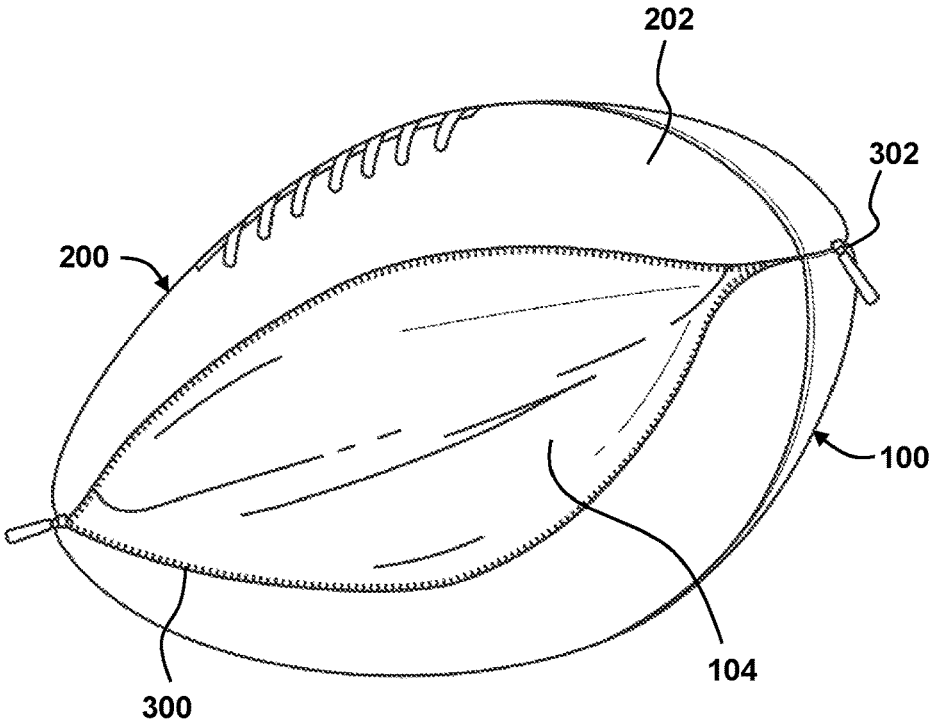
FIG. 3B depicts a second perspective view of the reversible hat of FIG. 1A with the hat portion functioning as a bladder for a pouch portion comprising the four-pointed flower shaped pattern, according to one embodiment.

FIG. 2B depicts a pouch portion 200 of the exemplary reversible hat of FIG. 1A. The pouch portion 200 has an outer surface 202, an opening 212, and peripheries 214 that are unattached until fastened (e.g., by a zipper).

Figure 2C:
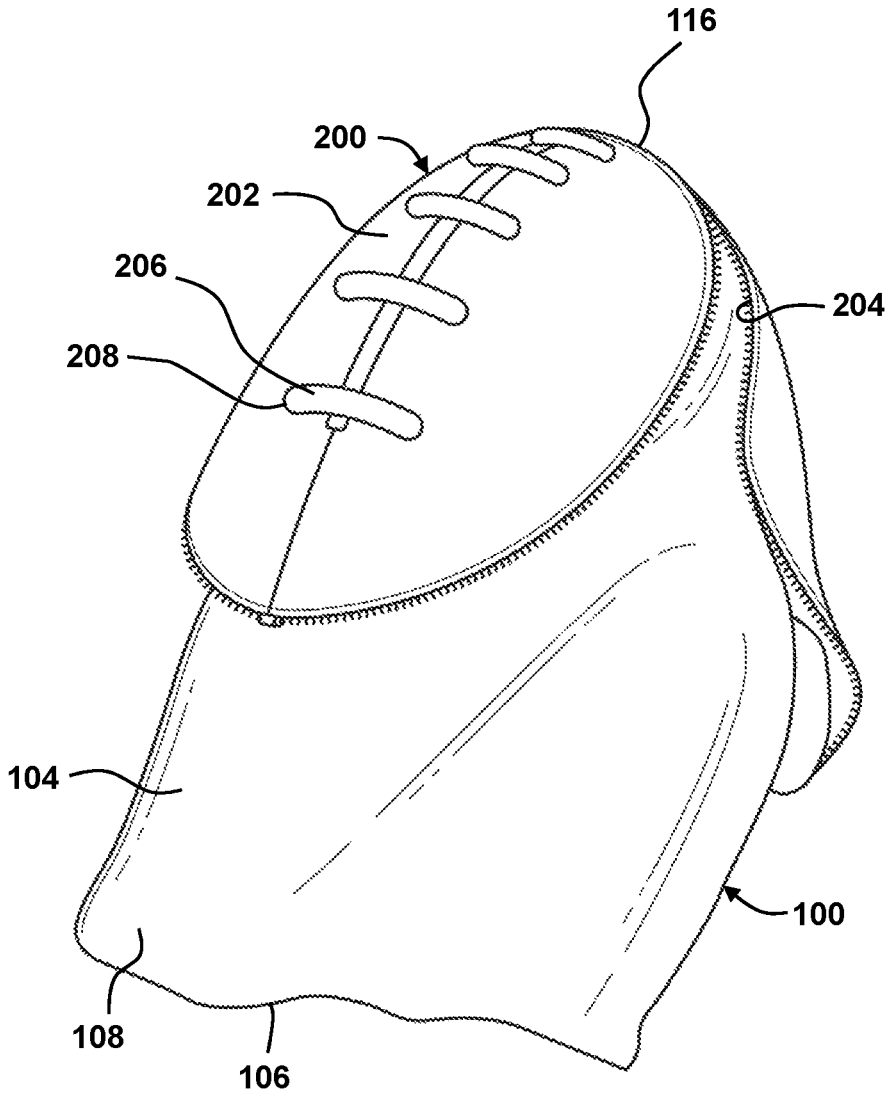
FIG. 2C depicts a perspective view of the reversible hat of FIG. 1A with the hat reversed, showing a second side of the hat, according to one embodiment.

FIG. 2C depicts a perspective view of the reversible hat 100 of FIG. 1A with the hat portion 104 reversed. The hat portion 104 is reversed such that the outer surface 108 is visible and the inner surface 106 is mostly hidden. In one embodiment, the pouch portion 200 comprises a pattern such as a four-pointed flower shaped pattern as shown in FIG. 2C. The four-pointed flower shaped pattern 200 has an outer surface 202 and an inner surface 204. The inner surface 202 of the four-pointed flower shaped pattern 200 is fixedly attached to the outer surface 108 of the hat portion 104 proximate the crown 116 of the hat 108. The four-pointed flower shaped pattern 200 may be fixedly attached to the outer surface 108 of the hat portion 104 via stitching, glue, fusing, etc. The four-pointed flower shaped pattern 200 may contain one or more elements such as laces 206 and grommets 208 to look like an outer surface of a football. In some embodiments, these elements may be printed onto the outer surface 202 of the four-pointed flower shaped pattern 200.

FIGS. 3A-3B depict perspective views of the reversible hat 100 of FIG. 1A with the hat portion 104 acting as a bladder for the four-pointed flower shaped pattern 200. The hat portion 104 material may be stuffed into, and enclosed by, the outer surface 202 of the four-pointed flower shaped pattern 200 to act as a bladder and provide support and shape to the ball. The reversible hat 100 includes a first fastener 300 and a second fastener 302 to detachably attach adjacent sides of the four-pointed flower shaped pattern 200. In some embodiments, the first and second fasteners 300, 302 may be zippers, snaps, buttons, magnets, hook and loop fasteners, adhesives, etc. Further materials for the pouch portion and/or hat portion can comprise plastics, synthetic materials, leathers, transparent material, semi-transparent material, reflective material, etc. Further materials for the pouch portion and/or hat portion can comprise flexible materials that can easily bend, flex, and be reversed (turned inside-out). Further, in one embodiment, the pouch portion and the hat portion are integrated such that the hat portion has zippers 300 affixed to the exterior of it, and there is no separate pouch portion.

Figure 4:
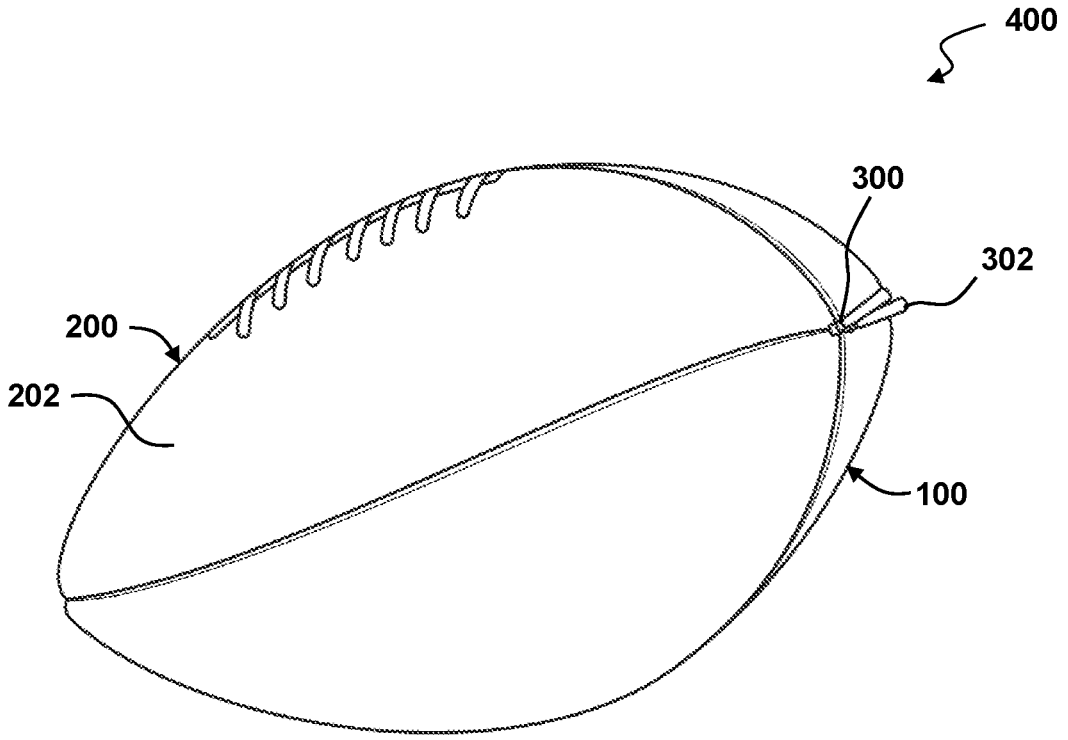
FIG. 4 depicts a perspective view of the reversible hat of FIG. 1A in a second position as a prolate spheroid, according to one embodiment.

FIG. 4 depicts a perspective view of the reversible hat 100 of FIG. 1A in a second position 400 as a prolate spheroid. When the first and second fasteners 300, 302 are secured, the hat portion 104 (See FIGS. 1-3) is disposed within the outer surface 202 of the four-pointed flower shaped pattern (i.e., pouch portion) 200, such that it is not visible to an external observer. In some embodiments, fasteners 300, 302 using zipper pulls may be tucked or otherwise hidden once the fasteners 300, 302 are secured. The reversible hat 100 is an oblate spheroid (i.e., a mini-football) and may be used as such. For example, a user may wear the reversible hat 100 to a football game in the first position (See FIG. 1A), turn the reversible hat 100 into a mini-football in the second position 400, play a game of catch with the mini-football, and then reverse the process shown in FIGS. 1-4 to turn the reversible hat 100 back into a hat for wearing in the first position.

Figure 5A:
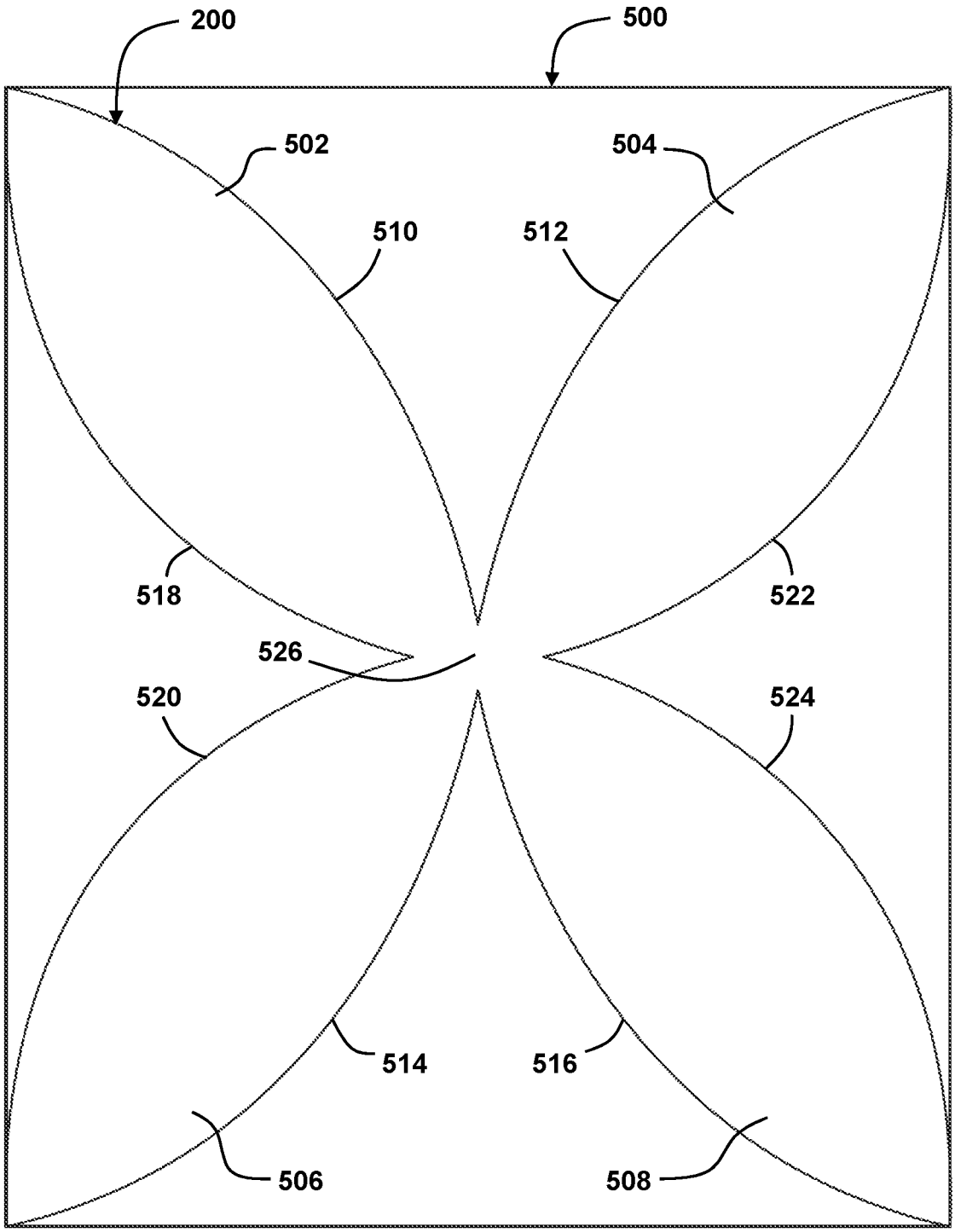
FIG. 5A depicts an exemplary pouch portion as a four-pointed flower shaped pattern for use in the reversible hat of FIGS. 1-4, according to one embodiment.

FIG. 5A depicts an exemplary four-pointed flower shaped pattern 200 for use in the reversible hat of FIGS. 1-4. The four-pointed flower shaped pattern 200 may be cut from a larger sheet of material 500. The sheet of material may be leather, rubber, plastic, etc. The four-pointed flower shaped pattern 200 includes: a first petal 502, a second petal 504, a third petal 506, and a fourth petal 508. Adjacent sides 510, 512 of the first petal 502 and the second petal 504, respectfully, may be fixedly attached. Adjacent sides 514, 516 of the third petal 506 and the fourth petal 508, respectfully, may be fixedly attached. The fixed attachment may be via stitching. A first fastener (See FIG. 4) detachably attaches adjacent sides 518, 520 of the first petal 502 and the third petal 506, respectfully. A second fastener (See FIG. 4) detachably attaches adjacent sides 522, 524 of the second petal 504 and the fourth petal 508, respectfully. The detachable attachment may be a zipper that is attached to respective sides 518, 520, 522, 524. A center portion 526 of the four-pointed flower shaped pattern 200 has portions of the petals 502, 504, 506, 508 connected. The center portion 526 of the pouch 200 is connected proximate the crown 116 of the hat 200.

Figure 5B:
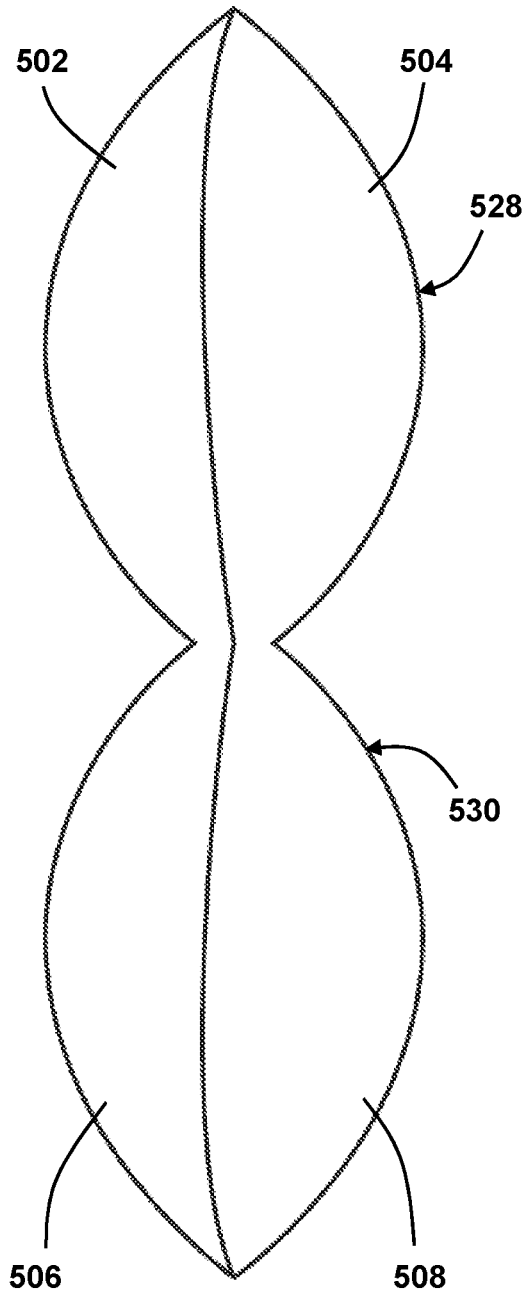
FIG. 5B depicts the exemplary four-pointed flower shaped pattern of FIG. 5A formed into two cups for the pouch portion, according to one embodiment.

FIG. 5B depicts the exemplary four-pointed flower shaped pattern of FIG. 5A formed into two cups 528, 530. The first cup 528 may be formed by joining the first petal 502 and the second petal 504. The second cup 530 may be formed be joining the third petal 506 and the fourth petal 508. The curvature of these cups 528, 530 aligns with the curvature at the top of the disclosed reversible hat so that these cups 528, 530 in the disclosed reversible hat are not immediately visible and distinguishable from a standard hat that is not reversible.

Figure 5C:
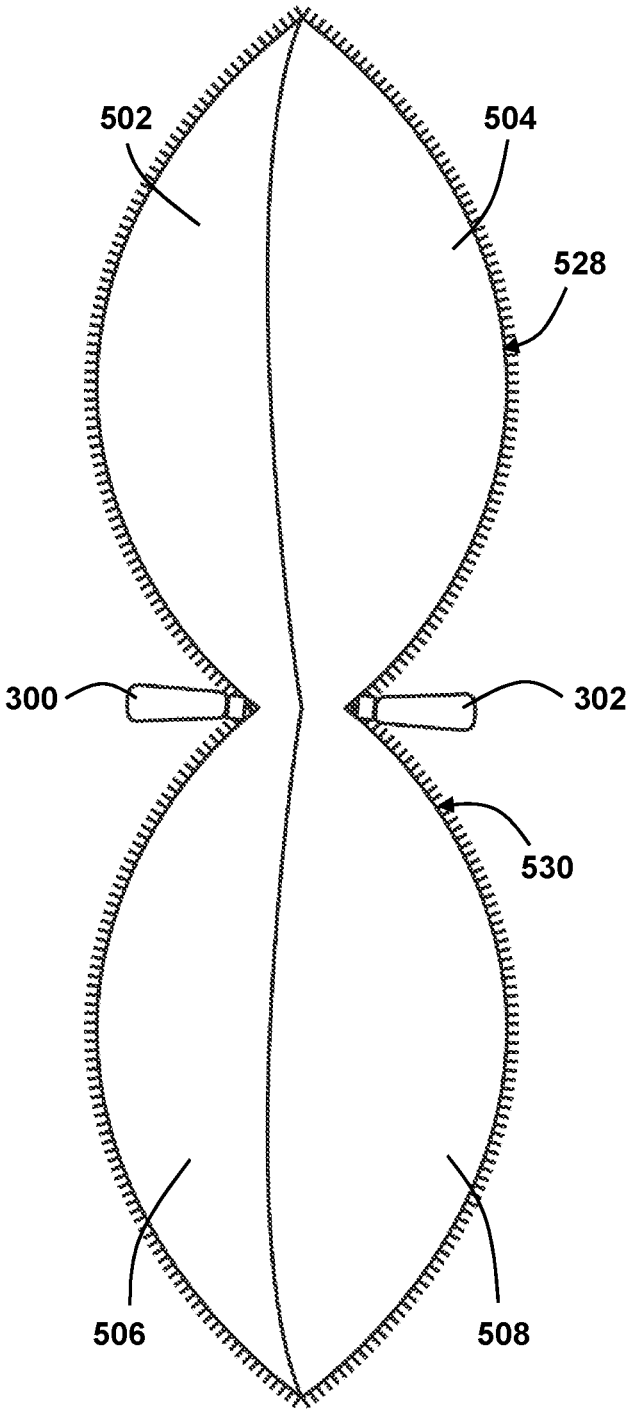
FIG. 5C depicts the exemplary four-pointed flower shaped pattern of FIG. 5A formed into two cups for the pouch portion and having two detachable attachments, according to one embodiment.

FIG. 5C depicts the exemplary four-pointed flower shaped pattern of FIG. 5A formed into two cups 528, 530 for the pouch portion and having two detachable attachments, according to one embodiment. Two detachable attachments 300, 302, such as zippers may be attached around the perimeter of the two cups 528, 530.

Figure 6A:
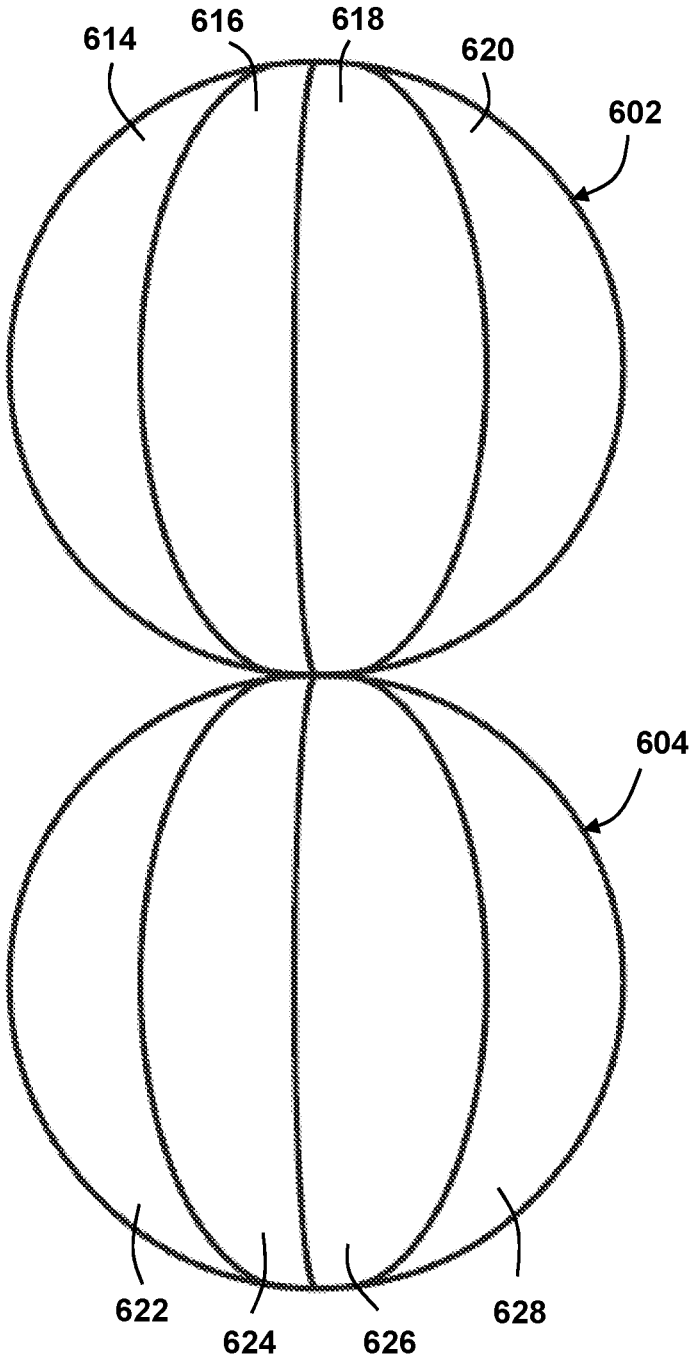
FIG. 6A depicts an exemplary plurality of panels forming a first sphere half of the pouch portion and a second sphere half of a pouch portion for an additional exemplary reversible hat embodiment.

FIG. 6A depicts an exemplary plurality of panels forming a first sphere half 602 and a second sphere half 604 for an additional exemplary reversible hat embodiment. A first plurality of panels 614, 616, 618, 620 may form a first sphere half 602. A second plurality of panels 622, 624, 626, 628 may form a second sphere half 604.

Figure 6B:
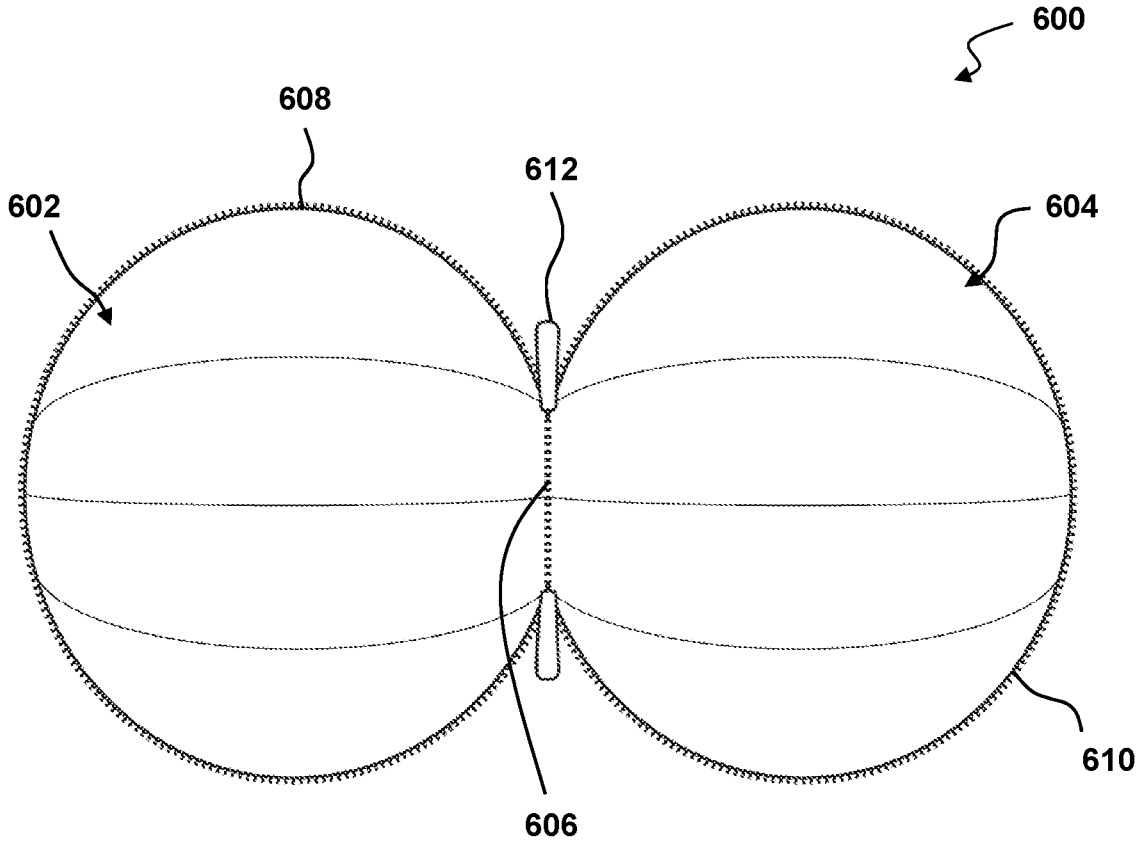
FIG. 6B depicts the additional exemplary reversible hat embodiment of FIG. 6A having fasteners attached, according to one embodiment.

FIG. 6B depicts the additional exemplary reversible hat embodiment of FIG. 6A having the plurality of panels 600 with fasteners attached. The plurality of panels 600 may form the first sphere half 602 and the second sphere half 604. A portion of an edge of the first sphere half 602 is fixedly attached 606 to a portion of an edge of the second sphere half 604, wherein a remaining edge 608 of the first sphere half 602 not fixedly attached to the second sphere half 604 is detachably attached to a remaining edge 610 of the second sphere half 604 via a fastener 612. In some embodiments, the fastener 612 may be a zipper. In some embodiments, only a single fastener 612 may be used, such as a zipper with a single zipper pull. In other embodiments, multiple zipper pulls may be used.

Figure 7:
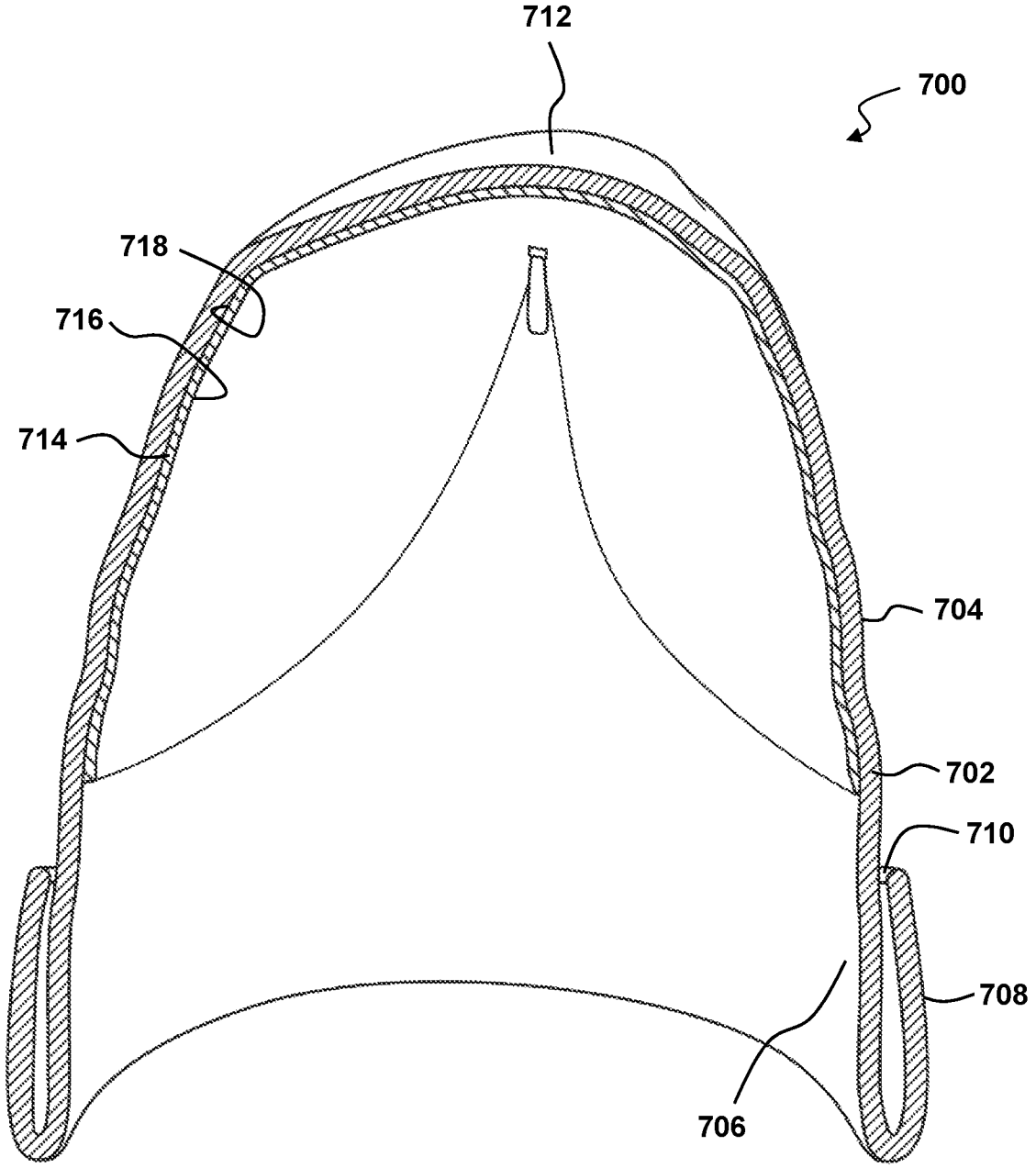
FIG. 7 depicts an exemplary cross-sectional view of an exemplary reversible hat of FIG. 1A, according to one embodiment.

FIG. 7 depicts an exemplary cross-sectional view of an exemplary reversible hat 700. The reversible hat includes a hat 702 having an outer surface 704 and an inner surface 706. The outer surface 704 and the inner surface 706 are relative and do not act to limit which side of the hat may be visible to an external observer. For example, in some embodiments, a user may create a cuff 708 by rolling an edge 710 of the hat up such that a portion of the inner surface 706 is visible to an external user as the cuff 708. The hat 702 may taper from a lower portion proximate an edge 710 of the hat 702 to an upper portion proximate a crown 712 of the hat 702. The hat 702 may be a knit cap, or beanie. A four-pointed flower shaped pattern 714 has an inner surface 716 and an outer surface 718. The inner surface 716 of the four-pointed flower shaped pattern 714 may be attached to the inner surface 706 of the hat 702 proximate the crown 712 of the hat 702.

Figure 8:
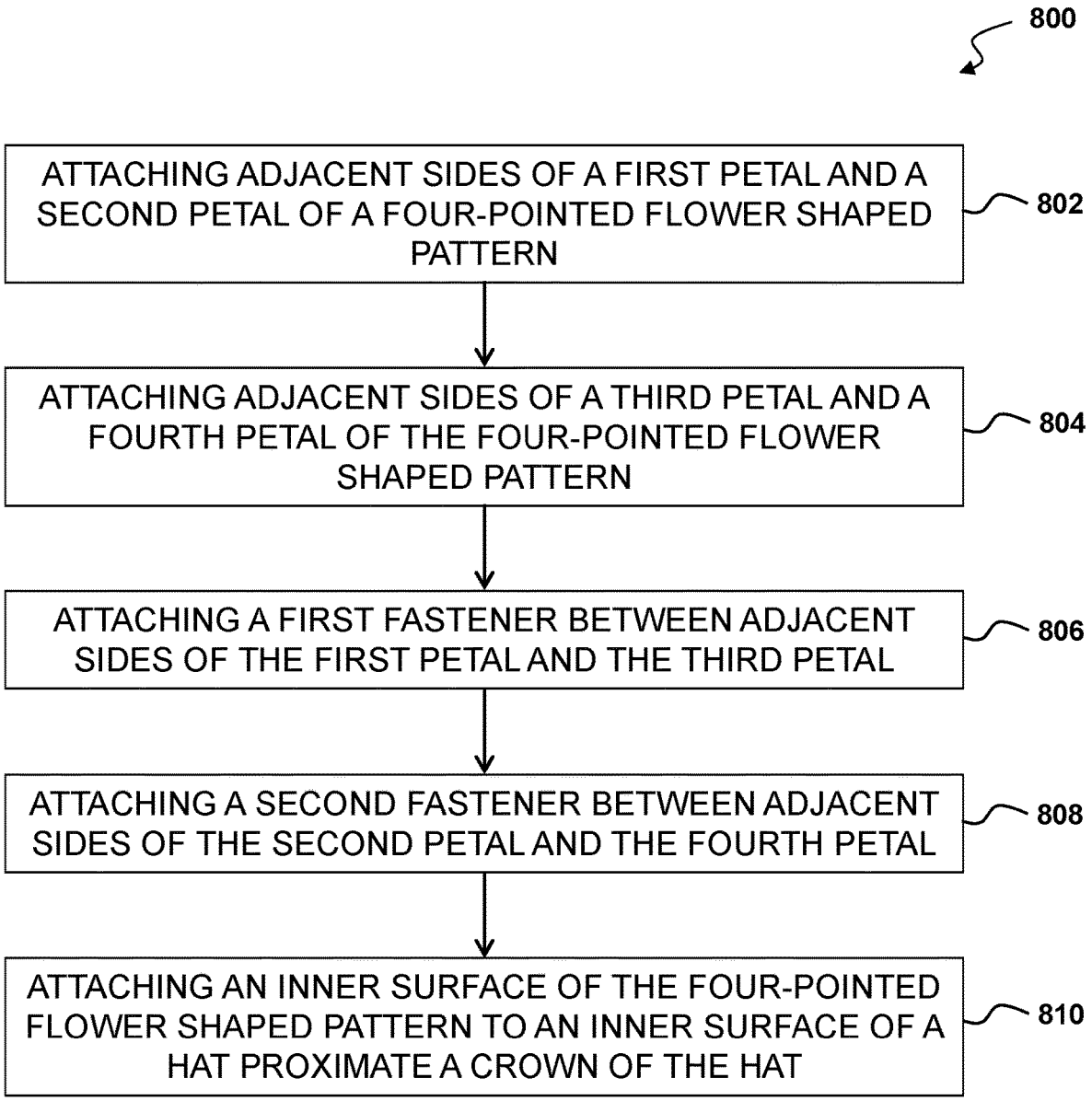
FIG. 8 depicts an exemplary functional block diagram showing a method of constructing an exemplary reversible hat, according to one embodiment.

FIG. 8 depicts an exemplary functional block diagram 800 showing a method constructing an exemplary reversible hat. The method includes attaching adjacent sides of a first petal and a second petal of a four-pointed flower shaped pattern (step 802). These adjacent sides may be attached fixedly, such as by stitching. Then, adjacent sides of a third petal and a fourth petal of the four-pointed flower shaped pattern are attached (step 804). These adjacent sides may be attached fixedly, such as by stitching. A first fastener is attached between adjacent sides of the first petal and the third petal (step 806). The first fastener may be a detachably attachable fastener, such as a zipper. A second fastener is attached between adjacent sides of the second petal and the fourth petal (step 808). The second fastener may be a detachably attachable fastener, such as a zipper. An inner surface of the four-pointed flower shaped pattern is attached to an inner surface of a hat (step 810). The four-pointed flower shaped pattern may be attached proximate a crown of the hat. The hat is reversible between a first position as a head covering and a second position as a prolate spheroid. The adjacent sides of the first petal and the second petal may be fixedly attached via stitching, and the adjacent sides of the third petal and the fourth petal may also be fixedly attached via stitching. The first fastener and the second fastener may be a zipper, a snap, a button, a magnet, a hook and loop fastener, and/or an adhesive.

Figure 9:
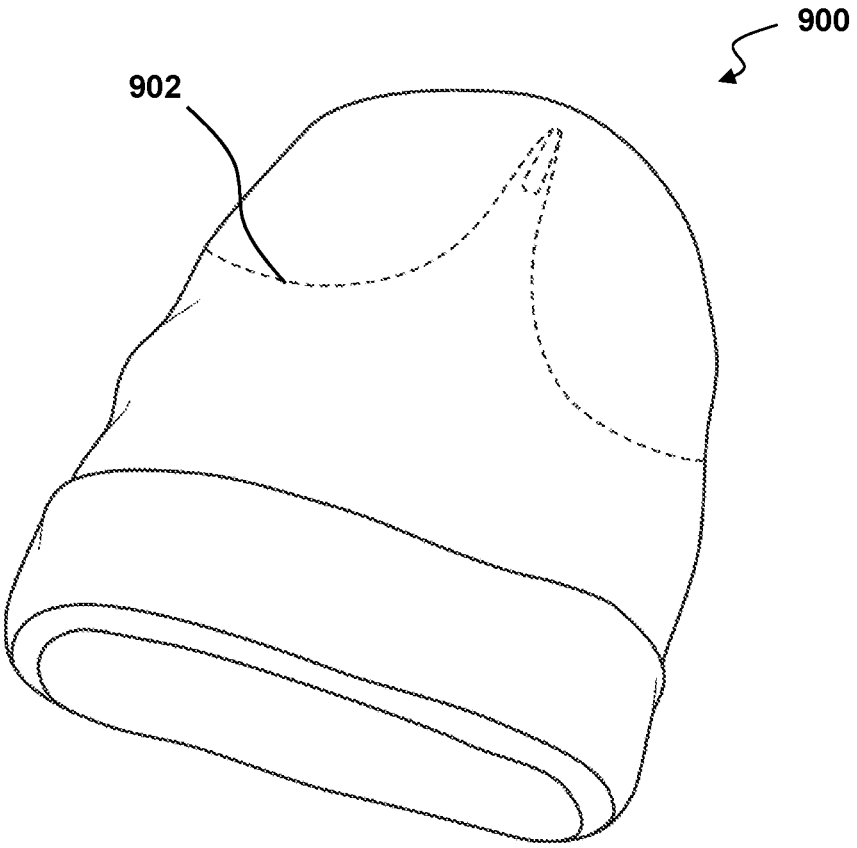
FIG. 9 depicts a perspective view of another embodiment of a reversible hat as a head covering in a first position and for turning into a sphere-shaped ball in a second position, according to one embodiment.

FIG. 9 depicts a perspective view of an additional reversible hat 900 for turning into a sphere-shaped ball in a first position as a head covering, with the location of the pouch 902 shown in dashed lines. The reversible hat 900 has similar features and elements as the reversible hat of FIG. 1A, except the reversible hat 900 turns into a sphere-shaped ball rather than a prolate spheroid-shaped ball.

Figure 10:
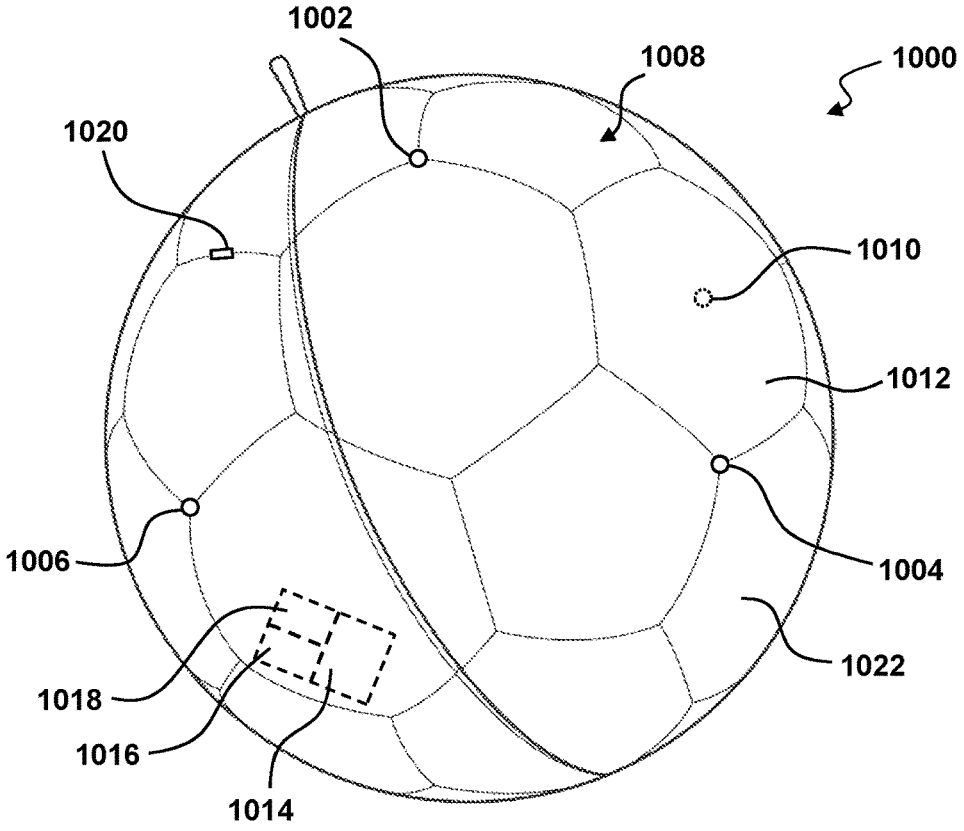
FIG. 10 depicts a perspective view of the reversible hat of FIG. 9 in a second position as a sphere having soccer ball surface indicia and one or more lighting devices such as light emitting diode lights, according to one embodiment.

FIG. 10 depicts a perspective view of the reversible hat of FIG. 9 in a second position as a sphere 1000 having soccer ball surface indicia and one or more lights. The reversible hat has one or more lights, such as light emitting diodes (LEDs) 1002, 1004, 1006. These LEDs 1002, 1004, 1006 may be positioned on an outer surface 1008 of the sphere 1000. The reversible hat may also have one or more LEDs 1010 that are disposed beneath the outer surface of the sphere, as shown in dashed lines. One or more panels 1012 of the sphere 1000 may be partially transparent to allow light from the LED to illuminate the panel 1012. In some embodiments, the sphere 1000 has a mix of transparent 1012 and opaque panels 1022. In other embodiments, the entire outer surface 1008 of the sphere 1000 may be transparent to allow illumination by LEDs.

In some embodiments, the sphere 1000 includes a battery 1014, processor 1016, and/or accelerometer 1018, as depicted in dashed lines. The accelerometer 1018 and/or processor 1016 may function to illuminate one or more LEDs 1002, 1004, 1006, 1010 continuously, following a pattern, or randomly when the sphere 1000 is in motion, such as when the sphere 1000 is being thrown. In other embodiments, one or more of the LEDs 1002, 1004, 1006, 1010 may illuminate continuously, following a pattern, or randomly, once the reversible hat is in the second position as a sphere 1000. In other embodiments, the LEDs 1002, 1004, 1006, 1010 may illuminate continuously, following a pattern, or randomly, once a switch 1020 is activated by a user. The LEDs on the reversible hat may allow the reversible hat to be used as a ball in the second position in limited lighting situations. While the lights, processor, accelerometer, etc. are depicted on a sphere, these elements may also be incorporated into a reversible hat that transforms into a football, baseball, basketball, soccer ball, rugby ball, volleyball, or golf club head cover.

Figure 11:
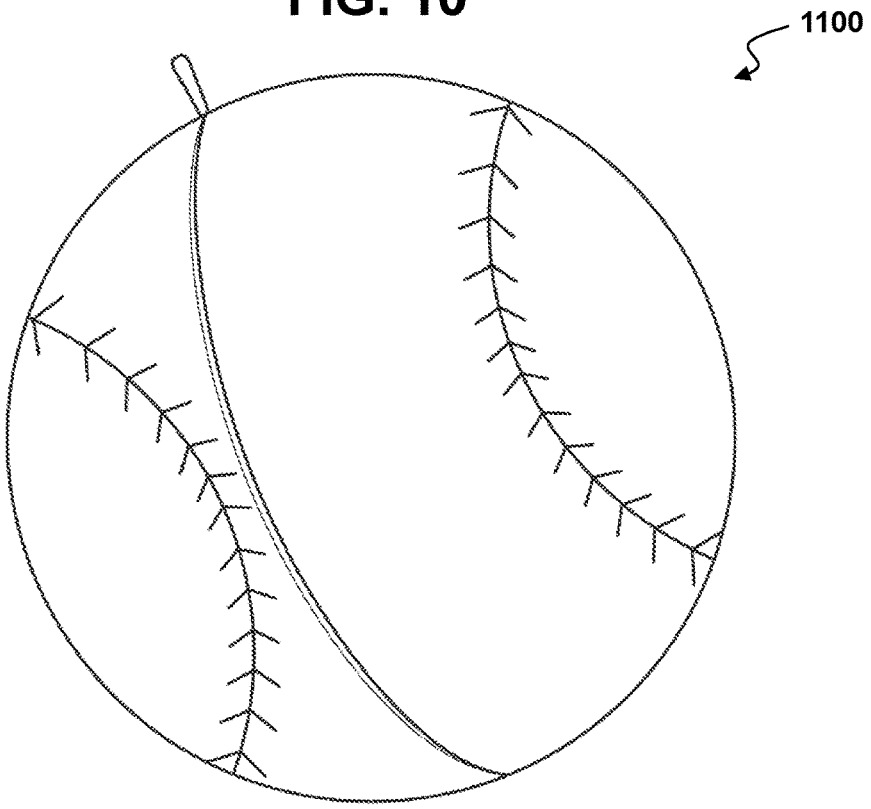
FIG. 11 depicts a perspective view of the reversible hat of FIG. 9 in a second position as a sphere having baseball surface indicia, according to one embodiment.

FIG. 11 depicts a perspective view of the reversible hat of FIG. 9 in a second position as a sphere 1100 having baseball surface indicia.

Figure 12:
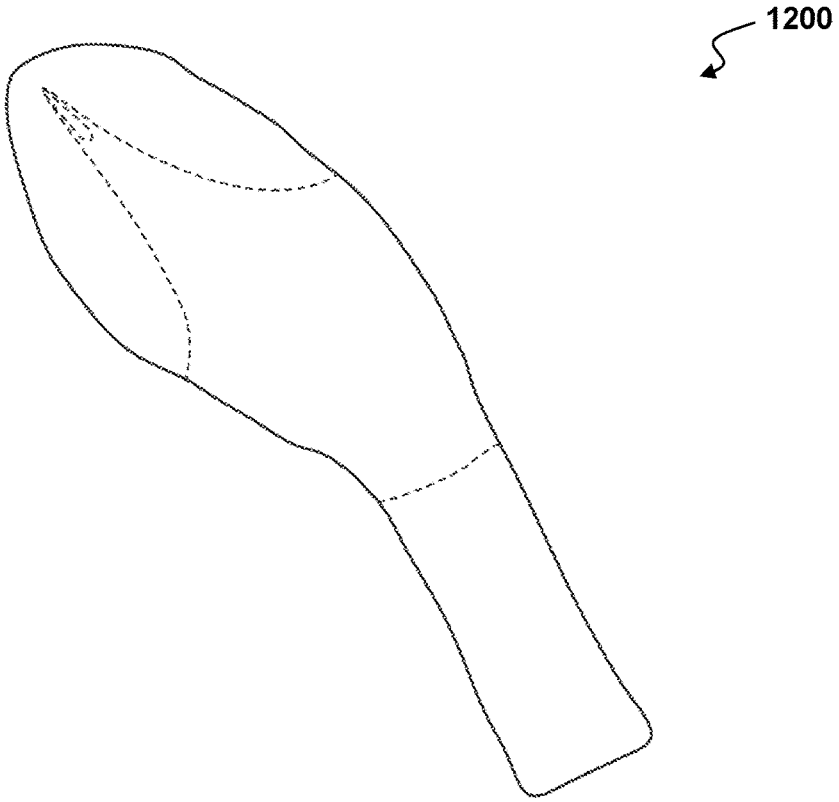
FIG. 12 depicts a perspective view of an exemplary reversible golf club head cover, shown in a first position as a club head cover, according to one embodiment.

FIG. 12 depicts a perspective view of an exemplary reversible golf club head cover 1200 in a first position as a club head cover. Dashed lines show the location of a four-pointed flower shaped pattern attached to the inner surface of the golf club head cover 1200.

Figure 13:
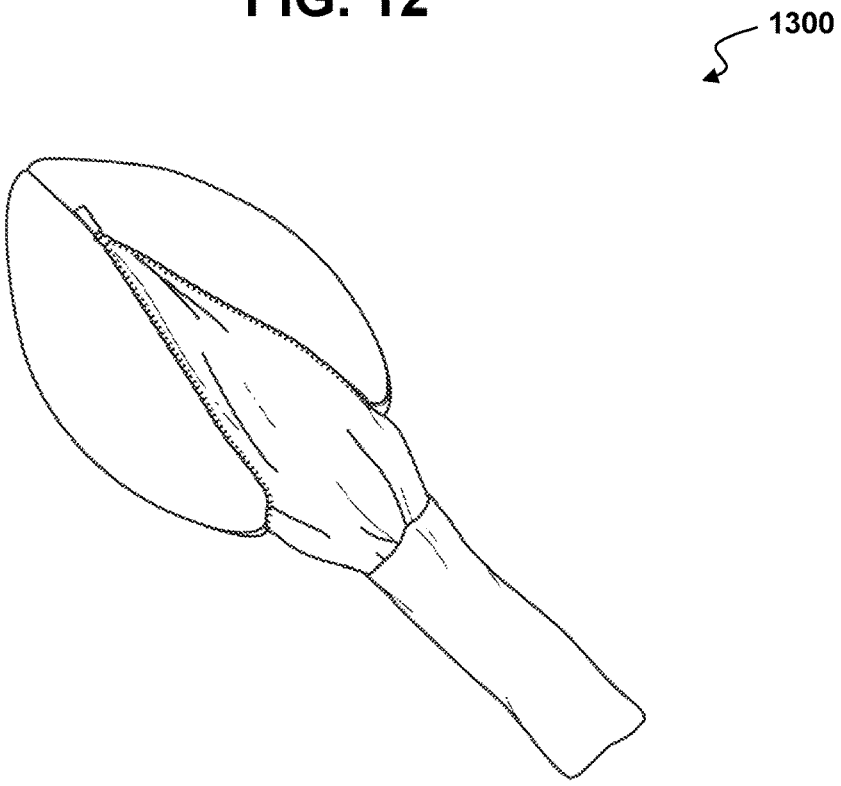
FIG. 13 depicts a perspective view of the exemplary reversible golf club head cover of FIG. 12 with the club head cover reversed in a second position, according to one embodiment.

FIG. 13 depicts a perspective view of the exemplary reversible golf club head cover of FIG. 12 with the club head cover reversed 1300. The golf club head cover material may be stuffed inside the four-pointed flower shaped pattern and act as a bladder for the ball. A prolate spheroid is depicted in this embodiment, but may be a baseball, basketball, soccer ball, rugby ball, or golf club head cover in other embodiments.

Figure 14:
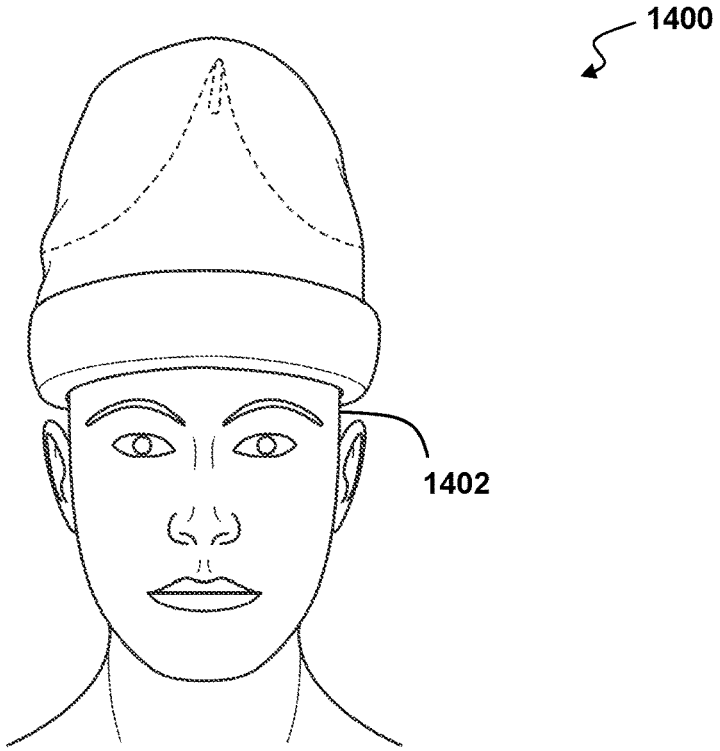
FIG. 14 depicts a perspective view of an exemplary reversible hat being worn on a user's head as a hat in the first position.

FIG. 14 depicts a perspective view of an exemplary reversible hat 1400 being worn on a user's head 1402 as a hat in the first position.

Figure 15:
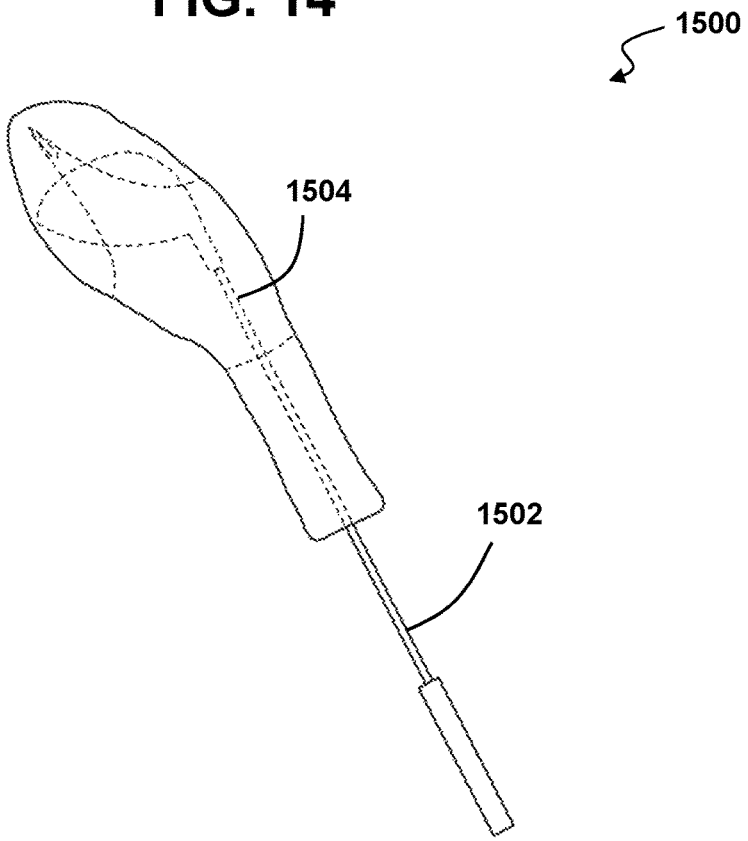
FIG. 15 depicts a perspective view of the exemplary reversible golf club head cover of FIG. 12 being placed over a golf club with the portion of the golf club instead the reversible golf club head cover being shown in dashed lines.

FIG. 15 depicts a perspective view of the exemplary reversible golf club head cover 1500 of FIG. 12 being placed over a golf club 1502 with the portion of the golf club inside the reversible golf club head cover being shown in dashed lines 1504.

Note that references throughout this specification to "an aspect" or "one aspect" mean that a particular feature, structure or characteristic described in connection with the aspect is included in at least one aspect of the present invention. Therefore, it is emphasized and should be appreciated that two or more references to "an aspect" or "one aspect" or "an alternative aspect" in various portions of this specification are not necessarily all referring to the same aspect. Furthermore, the particular features, structures or characteristics being referred to may be combined as suitable in one or more aspects of the invention, as will be recognized by those of ordinary skill in the art.

While the present disclosure is described above with respect to what is currently considered its preferred aspects, it is to be understood that the disclosure is not limited to that described above. To the contrary, the disclosure is intended to cover various modifications and equivalent arrangements within the spirit and scope of the appended claims.

What is claimed is:

1. A reversible hat, comprising:

a hat portion having an inner surface and an outer surface, the hat portion tapering from a lower portion proximate an edge to an upper portion proximate a crown; and a pouch portion having an inner surface and an outer surface, wherein the pouch portion comprises a four-pointed flower shaped pattern comprising the outer surface and the inner surface, the four-pointed flower shaped pattern comprising: a first petal, a second petal, a third petal, and a fourth petal, wherein adjacent sides of the first petal and the second petal are fixedly attached, wherein adjacent sides of the third petal and the fourth petal are fixedly attached;

wherein the hat portion is coupled to the pouch portion, the pouch portion having an opening for receiving the hat portion;

wherein the reversible hat is reversible between a first position as a head covering configured to receive a head of a user and a second position as a ball, wherein in the second position the hat portion is disposed within the pouch portion;

wherein in the first position an outer surface of the hat portion is disposed outwardly; and wherein in the second position an outer surface of the pouch portion is disposed outwardly, the peripheries of the pouch portion opening are attached to close the opening, such that the hat portion is disposed within the outer surface of the pouch portion;

wherein a first fastener detachably attaches adjacent sides of the first petal and the third petal, and wherein the first fastener extends between the first petal and the third petal;

wherein a second fastener detachably attaches adjacent sides of the second petal and the fourth petal, and wherein the second fastener extends between the second petal and the fourth petal;

wherein the inner surface of the pouch portion is fixedly attached to the inner surface of the hat portion proximate the crown;

wherein in the first position the outer surface of the hat portion is disposed outwardly, the adjacent sides of the first petal and the third petal are not attached, and the adjacent sides of the second petal and the fourth petal are not attached;

wherein in the second position the outer surface of the pouch portion is disposed outwardly, the adjacent sides of the first petal and the third petal are detachably attached, the adjacent sides of the second petal and the fourth petal are detachably attached to form a prolate spheroid, and the hat portion is disposed within the outer surface of the four-pointed flower shaped pattern as a bladder of the prolate spheroid; and wherein the reversible hat is capable of being converted from the first position to the second position by the user and vice versa.

2. The reversible hat of claim 1, wherein the hat portion is a knit cap.

3. The reversible hat of claim 1, wherein the hat portion is made of one or more of: wool, cotton, and synthetic fibers.

4. The reversible hat of claim 1, wherein the outer surface of the pouch portion comprises a printed pattern.

5. The reversible hat of claim 1, wherein the outer surface of the pouch portion comprises one or more laces.

6. The reversible hat of claim 5, wherein the outer surface of the pouch portion comprises one or more grommets.

7. The reversible hat of claim 1, wherein the inner surface of the pouch portion is fixedly attached to the inner surface of the hat portion via stitching.

8. The reversible hat of claim 1, wherein the first fastener and the second fastener are zippers.

9. The reversible hat of claim 1, wherein the first fastener and the second fasteners are at least one of: a zipper, a snap, a button, a magnet, a hook and loop fastener, and an adhesive.

10. The reversible hat of claim 1, wherein the pouch portion is made of one or more of: leather, rubber, and plastic.

11. The reversible hat of claim 1, wherein adjacent sides of the first petal and the second petal are fixedly attached via stitching, and wherein adjacent sides of the third petal and the fourth petal are fixedly attached via stitching.

12. The reversible hat of claim 11, wherein a curvature of the pouch portion aligns with a curvature of the hat portion proximate the crown.

* * * * *